US006520827B1

(12) United States Patent
Liu

(10) Patent No.: US 6,520,827 B1
(45) Date of Patent: Feb. 18, 2003

(54) SPINNING TOP

(76) Inventor: Kuo-Ching Liu, 5Fl., No. 11, Alley 1, Lane 1, Sec. 1, Yungans Rd., Lujou City, Taipei (TW), 247

( * ) Notice: Subject to any disclaimer, the term of this patent is extended or adjusted under 35 U.S.C. 154(b) by 0 days.

(21) Appl. No.: 10/162,900

(22) Filed: Jun. 6, 2002

(51) Int. Cl.[7] ..... A63H 1/00

(52) U.S. Cl. ..... 446/256; 446/36; 446/124; 446/263

(58) Field of Search ..... 446/263, 256, 446/264, 259, 262, 260, 257, 102, 108, 107, 105, 387, 388, 124, 35–38; 273/147; 473/588–589; D21/460–464

(56) References Cited

U.S. PATENT DOCUMENTS 2,977,701 A * 4/1961 Louderback
3,455,049 A * 7/1969 Dyer et al.
4,906,216 A * 3/1990 Abeshouse ..... 446/256
5,906,529 A * 5/1999 Spais ..... 446/36
5,908,342 A * 6/1999 Wolvin ..... 446/124
6,196,892 B1 * 3/2001 Danneberg ..... 446/256

* cited by examiner

*Primary Examiner*—Derris H Banks
*Assistant Examiner*—Jamila Williams
(74) *Attorney, Agent, or Firm*—Rosenberg, Klein & Lee

(57) ABSTRACT

A spinning top is built up with rigid flat parts and includes a central shaft extended through a horizontal body having a pair of radially oppositely projected fixed wings. A pair of movable wings are pivotally connected to an outer periphery of the horizontal body via two fixing arms to move between a fully folded position concealed below the horizontal body and a fully extended position projected from the outer periphery of the horizontal body. When the central shaft is twisted to eject the spinning top, the movable wings are pivotally thrown outward to serve as weapons providing enhanced attacking force in a fighting game using spinning tops and produce more fun.

7 Claims, 8 Drawing Sheets

SPINNING TOP

FIELD OF INVENTION

The present invention relates to a spinning top, and more particularly to a spinning top adapted to produce enhanced attacking force in a fighting game using spinning tops.

BACKGROUND OF THE INVENTION

A built-up toy is assembled from a plurality of flat parts detached from a flat board. A currently very popular way of playing the built-up toys is to conduct a fighting with two built-up toys, such as two built-up spinning tops. A built-up spinning top usually includes a plurality of round flat parts having a shaft extended therethrough. Two spinning tops in the fighting game collide with each other and the one that does not stop spinning wins the game. The conventional built-up spinning top does not include any special structural design to provide a strong attacking force. Moreover, the round flat parts have a fixed shape that makes the spinning top monotonous without too much fun.

SUMMARY OF THE INVENTION

A primary object of the present invention is to provide an improved built-up spinning top having a pair of movable wings that project outward when the top spins. When the projected movable wings contact with an opponent top or other articles, they would slightly move backward to produce a buffer effect, enabling the top to spin continuously without becoming tilted over.

Another object of the present invention is to provide a spinning top including a pair of movable wings serving as an interesting weapon. The movable wings are normally at a folded position to conceal below a horizontal body of the top, and adapted to swing outward to an extended position when the top spins.

A further object of the present invention is to provide a spinning top that is easily assembled from a plurality of differently shaped rigid flat parts, and these flat parts are detachably connected to the same one flat board before the parts are used to build up the spinning top. The inclusion of parts in the flat board enables convenient packing and transporting of the spinning top alone or along with other products.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
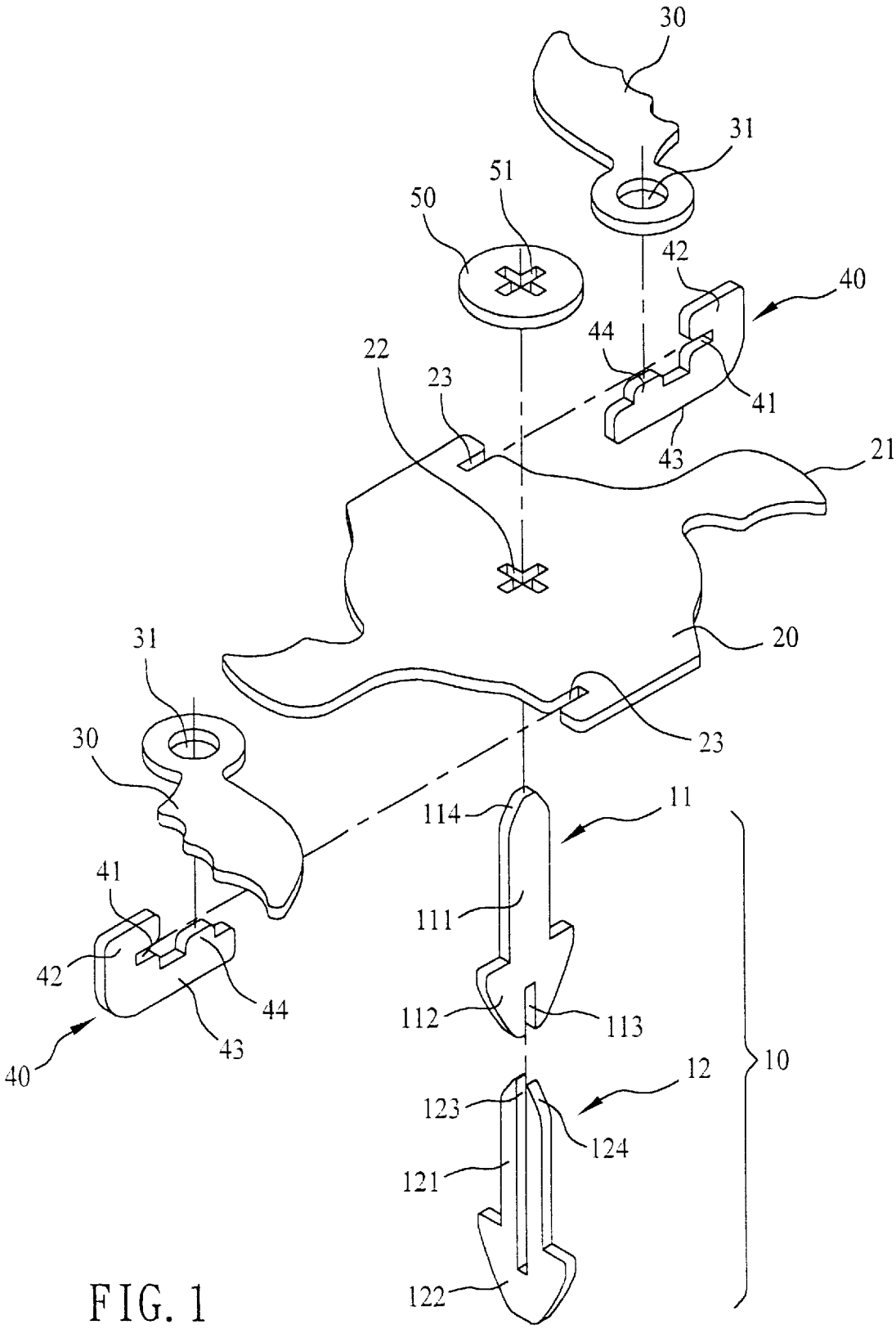
FIG. 1 is an exploded perspective view of a spinning top according to a preferred embodiment of the present invention.

Please refer to FIG. 1 that is an exploded perspective view of a spinning top according to a preferred embodiment of the present invention. As shown, the spinning top mainly includes a central shaft 10 formed from vertically intersected first and second shaft parts 11, 12, a horizontal body 20, a pair of movable wings 30, a pair of fixing arms 40, and an upper fixing disc 50. All these components are flat parts.

The first shaft part 11 of the central shaft 10 includes an elongate upper shaft portion 111 having an upward tapered head 114, and an expanded arrow-shaped lower portion 112 having a short slit 113 upward extended from a bottom center thereof. The second shaft part 12 includes an elongate upper shaft portion 121 having an upward tapered head 124 and a long slit 123 downward extended from a top center of the tapered head 124, and an expanded arrow-shaped lower portion 122. The first and the second shaft part 11, 12 are connected together through engagement of the short slit 113 with the long slit 123 to form the central shaft 10 that has a cross-shaped cross section.

The horizontal body 20 includes two radially opposite fixed wings 21. In the illustrated preferred embodiment, the fixed wings 21 are in the form of two blades. A cross-shaped hole 22 is provided at a center of the horizontal body 20. Two substantially radially opposite engaging slits 23 are provided at an outer periphery of the horizontal body 20 to extend in directions parallel with the fixed wings 21.

The movable wings 30 in the preferred embodiment are also in the form of two blades. An inner end of each movable wing 30 is formed into a round hole 31.

Each of the fixing arms 40 is a generally L-shaped flat part including a vertical portion 42 and a horizontal portion 43. A horizontal cut 41 is provided at a joint of the vertical and the horizontal portion 42, 43 for engaging with the engaging slit 23 on the horizontal body 20, and a short boss 44 is upward extended from an upper side of the horizontal portion 43. The boss 44 has an overall width smaller than an inner diameter of the round hole 31 of the movable wing 30.

The movable wings 30 are rotatably located at a lower side of the horizontal body 20 by separately engaging the round holes 31 of the movable wings 30 with the bosses 44 on the fixing arms 40, and then separately engaging the cuts 41 of the two fixing arms 40 with the two engaging slits 23 on the horizontal body 20 to locate the vertical portions 42 of the fixing arms 40 above the horizontal body 20 and the horizontal portion 43 below the horizontal body 20.

The upper fixing disc 50 has a diameter smaller than that of the horizontal body 20 and is provided at a center with a cross-shaped hole 51, via which the central shaft 10 is upward extended to fix the horizontal body 20 in place.

To use the above components to build up the spinning top of the present invention, first intersect the first and the second shaft parts 11, 12 to form the central shaft 10, and then upward extend the elongate upper shaft portions 111, 121 of the central shaft 10 through the cross-shaped hole 22 on the horizontal body 20 and put the fixing disc 50 on the intersected elongate upper shaft portions 111, 121. The tapered heads 114, 124 of the elongate shaft portions 111, 121 enable easy extending of the latter through the cross-shaped holes 22 and 51.

Figure 2:
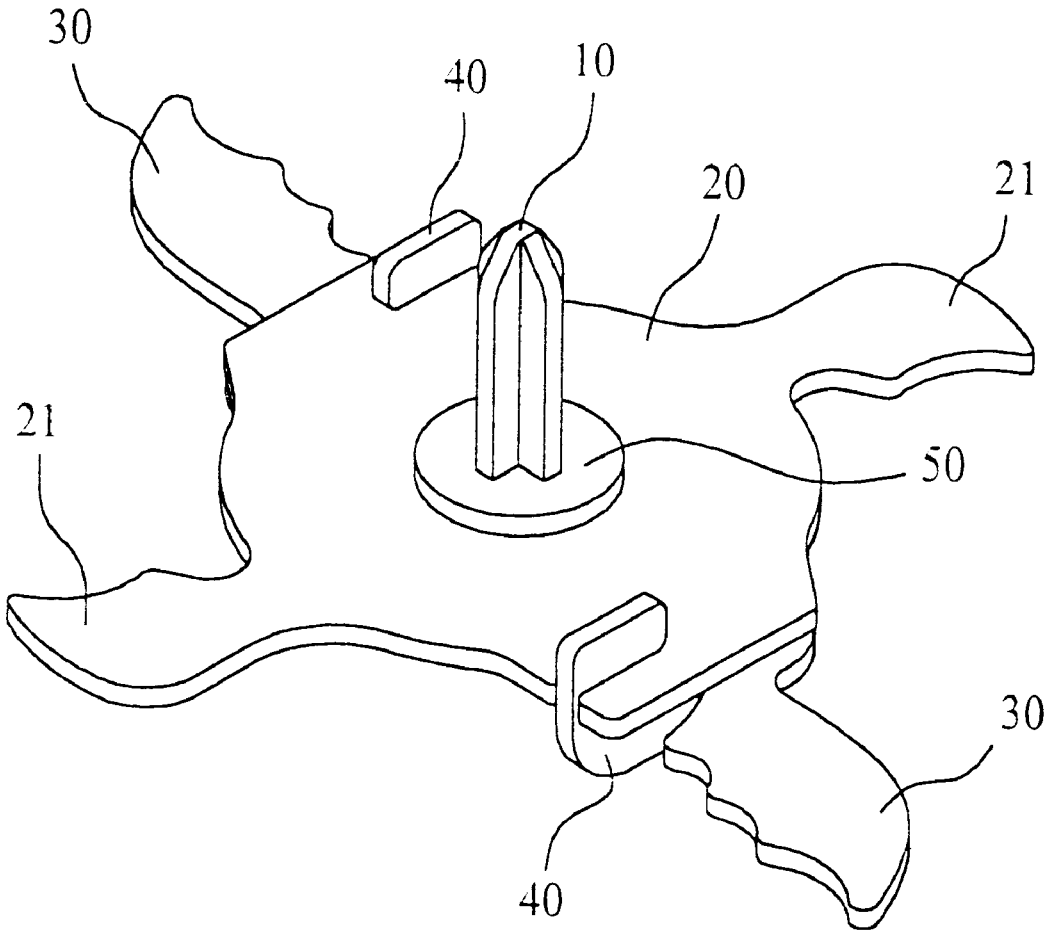
FIG. 2 is an assembled top perspective view of FIG. 1.
Figure 3:
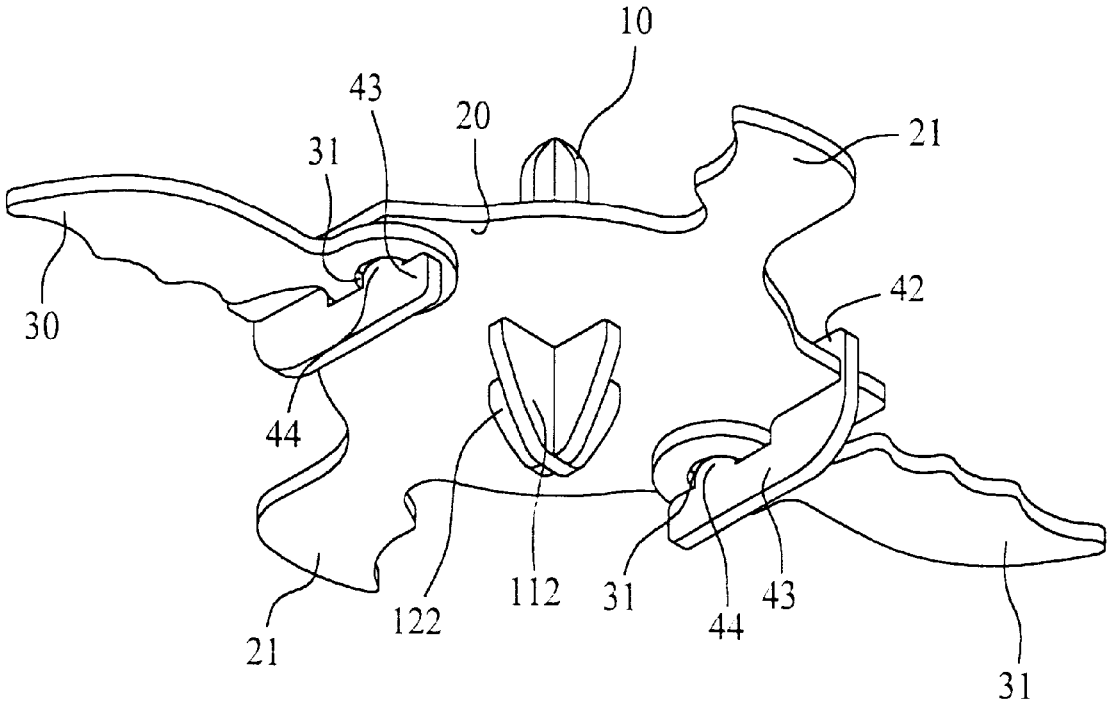
FIG. 3 is an assembled bottom perspective view of FIG. 1 with two movable wings thereof at a fully extended position.
Figure 4:
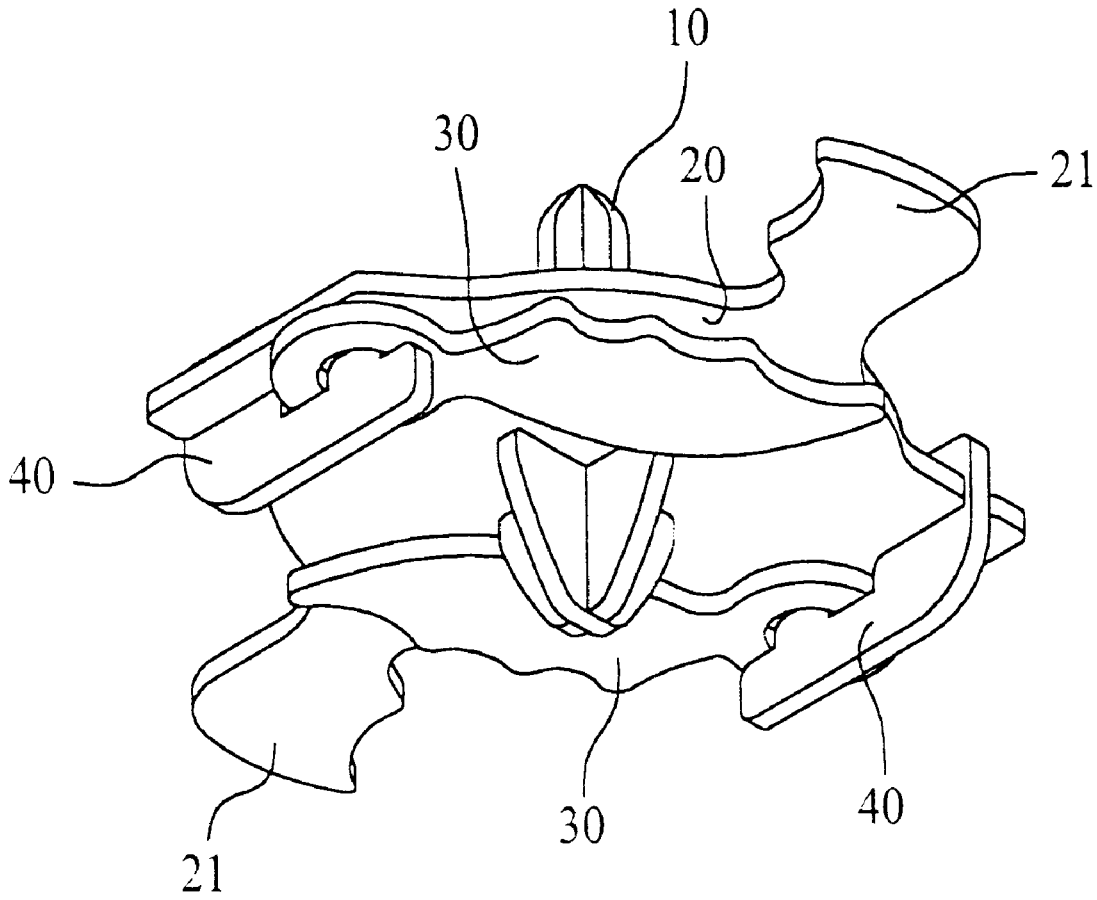
FIG. 4 is similar to FIG. 3 but with the two movable wings at a fully folded position.

Thereafter, engage the round holes 31 of the movable wings 30 with the bosses 44 on the fixing arms 40, and engage the horizontal cuts 41 on the fixing arms 40 with the engaging slits 23 on the horizontal body 20, so that the movable wings 30 are located below the horizontal body 20. FIGS. 2 and 3 are top and bottom perspective views, respectively, of an assembled spinning top of the preferred embodiment of the present invention, wherein the movable wings 30 are at an extended position to project from the horizontal body 20. FIG. 4 is also a bottom perspective view of the assembled spinning top of the present invention but with the movable wings 30 at a folded position concealed below the horizontal body 20.

Figure 5:
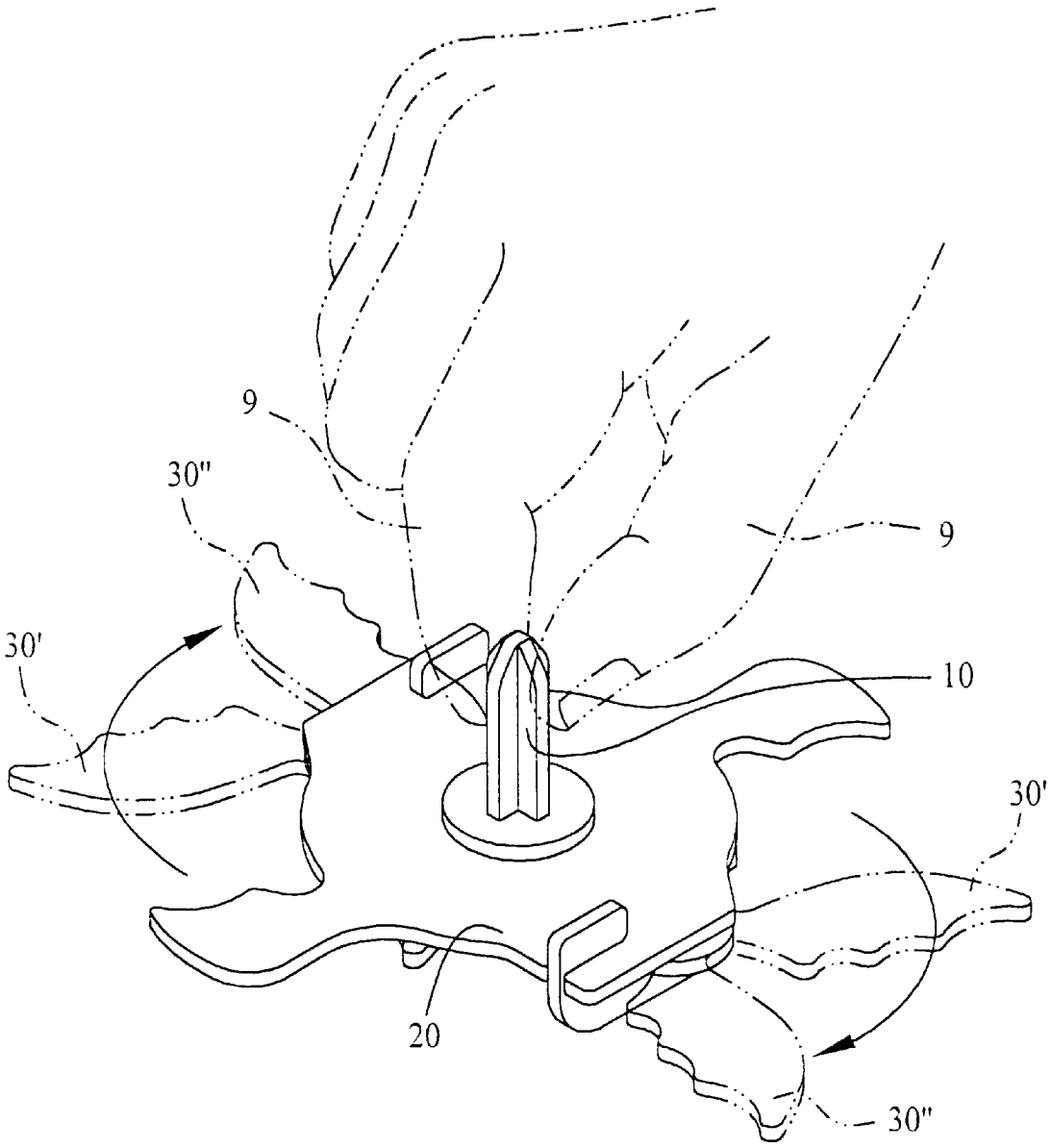
FIG. 5 shows the manner of turning the spinning top of the present invention.
Figure 6:
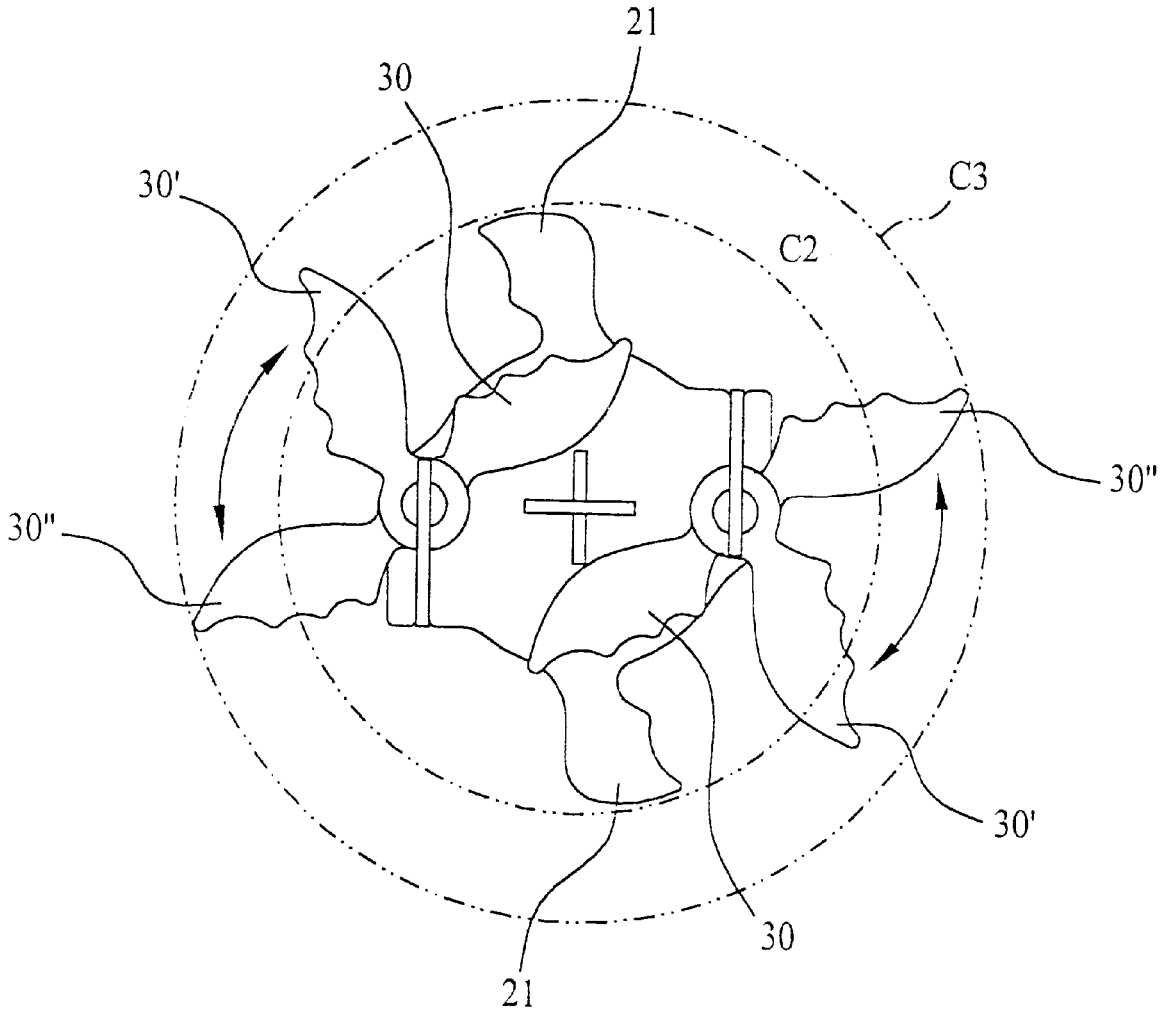
FIG. 6 is a bottom plan view of the present invention showing different positions of the movable wings when the spinning top is turned.

FIG. 5 shows the manner of turning the spinning top of the present invention. As shown, first locate the movable wings 30 at the folded position, and a player may eject the spinning top by twisting the elongate upper shaft portions 111, 121 of the central shaft 10 with a thumb and an index finger. At this point, the movable wings 30 connected to the bosses 44 below the horizontal body 20 are pivotally thrown outward from the folded position 30 to a half-extended position 30' and then the fully extended position 30", as shown in FIG. 6. The expanded arrow-shaped lower portions 112, 122 of the central shaft 10 located below the horizontal body 20 enable the ejected spinning top to stably spin about a bottom center of the central shaft 10.

Please refer to FIG. 6. When the spinning top is spinning, and the movable wings 30 are thrown out to the fully extended positions 30" a relative diameter defined by the two fully thrown-out movable wings 30 for a circle C3 is larger than a relative diameter defined by the two fixed wings 21 for a circle C2. When the spinning top collides with another top or other articles, the fully extended movable wings 30" would touch the other top or article f first and are f forced to move backward to the positions 30'. The backward movement of the fully extended movable wings 30" produces a buffer effect so that the spinning top does not stop spinning at the moment touching with other top or article. This design provides the spinning top an increased stability and accordingly enhanced attacking force when the spinning top contacts with other top in a fighting game using tops.

Figure 7:
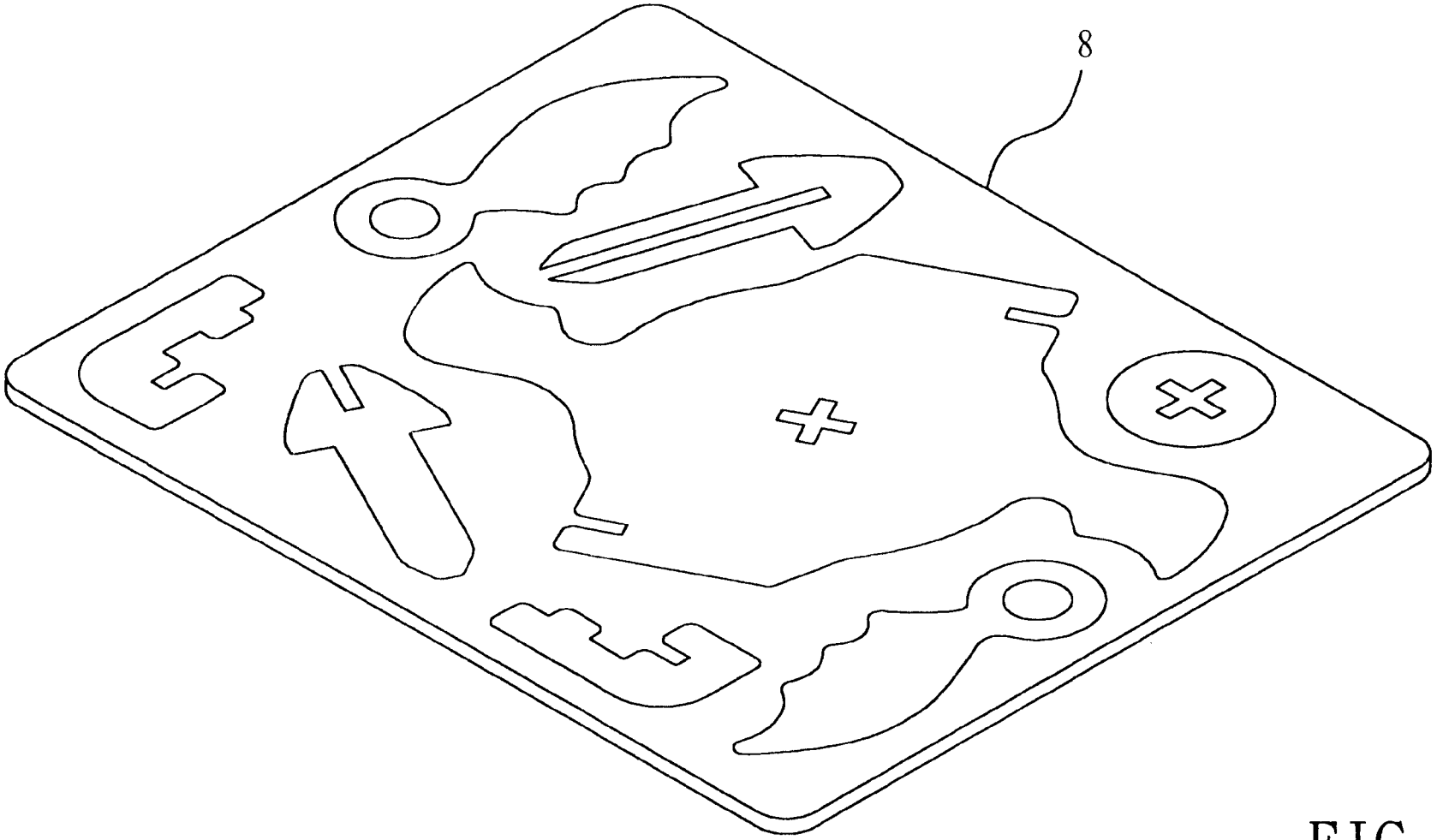
FIG. 7 shows all parts forming the spinning top of the present invention are included in a flat board before they are used to build up the spinning top.

As mentioned above, all the components forming the spinning top of the present invention are flat parts that are detachably set in a flat board 8 before they are used to build up the spinning top, as shown in FIG. 7. The flat board 8 enables the present invention to be easily packed and transported alone or along with other products.

Figure 8:
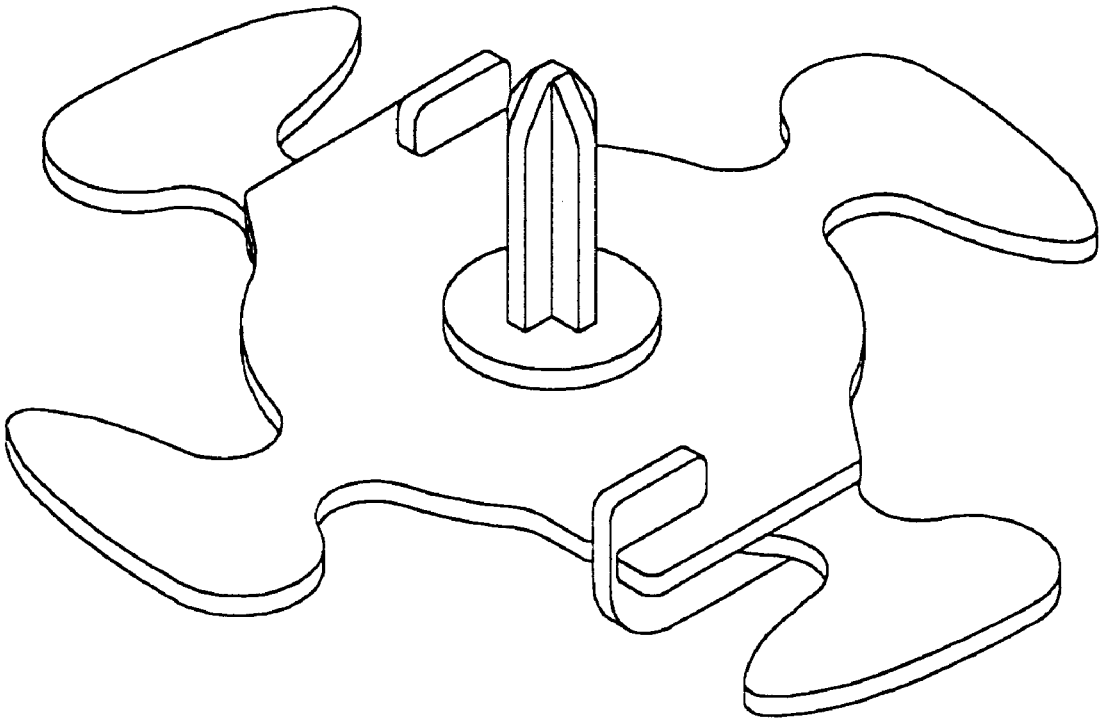
FIG. 8 is an assembled perspective view of a spinning top according to another embodiment of the present invention.

It is appreciated the fixed and the movable wings 21, 30 may be differently designed to show various kinds of shapes. FIG. 8 is an assembled perspective view of a spinning top according to another embodiment of the present invention, in which the wings are in the shape of a weapon used by Ninja Turtles, a group of famous cartoon figures.

The present invention has been described with some preferred embodiments thereof and it is understood that many changes and modifications in the described embodiments can be carried out without departing from the scope and the spirit of the invention as defined by the appended claims.

What is claimed is:

1. A spinning top, comprising:

a central shaft including an elongate upper shaft portion and an expanded arrow-shaped lower portion;

a horizontal body provided at a center with a central hole for said central shaft to extend therethrough, and at an outer periphery with a pair of radially opposite fixed wings;

a fixing disc having a central hole for said central shaft to extend therethrough, in order to locate above and hold down said horizontal body; and a pair of movable wings being pivotally connected to a lower side of said horizontal body via a pair of fixing arms, in order to move between a fully folded position concealed below said horizontal body and a fully extended position projected from the outer periphery of said horizontal body; and said movable wings being adapted to pivotally swing out of the outer periphery of said horizontal body when a player twists said elongate upper shaft portion of said central shaft to eject said spinning top.

2. The spinning top as claimed in claim 1, wherein each of said movable wings is provided at an inner end with a round hole, and each of said fixing arms includes an upward short boss for engaging with said round hole of said movable wing to pivotally connect said movable wing to the lower side of said horizontal body.

3. The spinning top as claimed in claim 1, wherein said central shaft is formed from intersected first and second shaft parts to have a cross-shaped cross section.

4. The spinning top as claimed in claim 3, wherein said central holes provided on said horizontal body and said fixing disc are cross-shaped holes corresponding to said cross-shaped cross section of said central shaft.

5. The spinning top as claimed in claim 3, wherein said central shaft includes an upward tapered upper end.

6. The spinning top as claimed in claim 1, wherein said fixed and said movable wings are in the shape of a blade, and said two movable wings together defines a relative diameter larger than that defined by said two fixed wings.

7. The spinning top as claimed in claim 1, wherein said central shaft, said horizontal body, said fixing disc, said movable wings, and said fixing arms all are flat parts that are detachably connected to a flat board before being used to build up said spinning top.

* * * * *